US007479738B2

(12) United States Patent
Lin

(10) Patent No.: US 7,479,738 B2
(45) Date of Patent: Jan. 20, 2009

(54) DRIVE CIRCUIT FOR LIGHT EMITTING DIODE

(75) Inventor: Yi-Sheng Lin, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 35 days.

(21) Appl. No.: 11/727,120

(22) Filed: Mar. 23, 2007

(65) Prior Publication Data

US 2008/0157687 A1 Jul. 3, 2008

(30) Foreign Application Priority Data

Dec. 29, 2006 (TW) ..... 95150085 A

(51) Int. Cl.
*H05B 37/00* (2006.01)

(52) U.S. Cl. ..... 315/185 S; 315/185 R; 315/291; 315/307

(58) Field of Classification Search ..... 315/185 R, 315/185 S, 209 R, 224–225, 246, 291, 307, 315/312; 345/204
See application file for complete search history.

(56) References Cited

U.S. PATENT DOCUMENTS 6,870,328 B2 * 3/2005 Tanabe et al. ..... 315/291
7,045,974 B2 5/2006 Lin et al.
2005/0057179 A1 * 3/2005 Madhani et al. ..... 315/185 R
2006/0186827 A1 * 8/2006 Ragonesi et al. ..... 315/185 S
2007/0024213 A1 * 2/2007 Shteynberg et al. ..... 315/291
2007/0188112 A1 * 8/2007 Kang et al. ..... 315/291
2008/0001547 A1 * 1/2008 Negru ..... 315/189
2008/0129220 A1 * 6/2008 Shteynberg et al. ..... 315/291

FOREIGN PATENT DOCUMENTS

KR 10-2006-0116736 5/2006

* cited by examiner

*Primary Examiner*—David Hung Vu
*Assistant Examiner*—Tung X Le
(74) *Attorney, Agent, or Firm*—Birch, Stewart, Kolasch & Birch, LLP

(57) ABSTRACT

A drive circuit for light emitting diode (LED) is provided, which is used to drive a plurality of LEDs to emit light. The LEDs are connected in series into a plurality of LED strings. The drive circuit includes a power converter, a detection circuit, and a report circuit. The power converter provides a driving voltage to the LED strings, and the detection circuit detects a string voltage of each LED string, and compares the string voltage with a default reference voltage, so as to determine whether the string voltage is different from the reference voltage (which indicates that the LED string is operated under a non-default state), and sends a detection signal to the report circuit. The report circuit receives the detection signal and outputs the control signal to the power converter, such that the power converter adjusts the driving voltage according to the control signal.

15 Claims, 5 Drawing Sheets

DRIVE CIRCUIT FOR LIGHT EMITTING DIODE

CROSS-REFERENCE TO RELATED APPLICATIONS

This non-provisional application claims priority under 35 U.S.C. § 119(a) on Patent Application No(s). 095150085 filed in Taiwan, R.O.C. on Dec. 29, 2006, the entire contents of which are hereby incorporated by reference.

BACKGROUND OF THE INVENTION

1. Field of Invention

The present invention relates to a drive circuit for light emitting diode (LED), and more particularly, to an LED drive circuit for driving and connecting a plurality of serially connected LED circuits in parallel.

2. Related Art

Light emitting diodes (LEDs) are widely used in daily life in recent years, such as in displays, household appliances, vehicle electronic components, and lighting lamps. Taking the displays as an example, a conventional display includes lamp sets of three-color lights, namely, a red (R) lamp set, a green (G) lamp set, and a blue (B) lamp set. Before the lamp sets of three-color lights are assembled, it shall be determined first whether LED bulbs in the lamp set of each color have the same characteristic through the test method of first applying a same current on them, and then dividing them into lamp sets of three-color lights based on whether the intensity, color, forward bias (Vf) of light are similar. However, after the display is used for a long time, the luminance of one LED bulb in the lamp set of a certain color often becomes insufficient, which causes non-uniform luminance in the white light produced through the mixture of the R, G, and B lights of the entire color light lamp sets. Since the LED light lamp set is usually a modulated product, it is a waste of time and labor to find the defective LED bulb from so many LED bulbs.

In order to solve the above problem that the LED light lamp set cannot detect the luminance of the LED lamp sets therein in time, U.S. Patent Publication No. 7,045,974 discloses an LED optical energy detection and feedback device, which is shown as FIG. 1. FIG. 1 is a schematic view of an optical energy detection and feedback device of the conventional art. As shown in FIG. 1, the conventional optical energy detection and feedback system includes an energy sensor 20, a power/voltage converter 30, an analog/digital converter 40, an operation processor 50, and a driver set 60.

The energy sensor 20 has three phototransistors 22, 24, and 26. The power/voltage converter 30 is used to convert current signals transmitted from the phototransistors 22, 24, and 26 into voltage signals, and then output the voltage signals to the analog/digital converter 40. The analog/digital converter 40 is used to convert the analog (voltage) signals transmitted from the power/voltage converter 30 into digital signals, and then transmit the digital signals to the operation processor 50. The driver set 60 has three driving ICs 62, 64, and 66, and when a control instruction transmitted from the operation processor 50 is received, the driving ICs 62, 64, and 66 adjust the current of LED lamp sets. Moreover, the LED lamp set 70 has a red LED lamp group 72, a green LED lamp group 74, and a blue LED lamp group 76, which are respectively connected in series with a detection red LED, a detection blue LED, and a detection green LED of the same property, such that the phototransistors 22, 24, and 26 respectively detect the luminance of the light emitted from the red LED lamp group, blue LED lamp group, and green LED lamp group of the LED lamp set 70, and then convert into current values and transmit to the power/voltage converter 30. Thus, when the bulb of one color in the LED lamp set 70 is abnormal, the current signals transmitted from the phototransistors 22, 24, and 26 and received by the power/voltage converter 30 are converted, and then transmitted to the operation processor 50 by the analog/digital converter 40. Since the operation processor 50 has stored the default luminance reference values of the red LED lamp group, blue LED lamp group, and green LED lamp group, which color light LED lamp group that the abnormal lamp is in can be detected after through determination and comparison, and then the light of a uniform luminance can be emitted from the LED lamp set 70 by ordering one of the driving ICs 62, 64, and 66 to make compensation.

The LED lamp set 70 can use three detection LEDs to detect the luminance of the light of the red LED lamp group, blue LED lamp group, and green LED lamp group, and the luminance values of the LED lamp groups of three color lights are respectively transmitted to the power/voltage converter 30 through the phototransistors 22, 24, and 26. However, the luminance values of the LED lamp groups of three color lights are detected by the phototransistors 22, 24, and 26 at the same time, and then transmitted to the power/voltage converter 30 synchronously. When the number of the lamp groups of the LED lamp set 70 is increased and the number of the bulbs in the lamp group is increased, the number of the matching phototransistors is increased correspondingly, and thus, not only the forward bias (Vf) of the LED lamp set 70 will be excessively high, but also when a plurality of bulbs or bulbs in different lamp groups in the LED lamp set 70 are abnormal, the operation processor 50 cannot determine and adjust the needed luminance compensation value of the light of the LED groups.

Moreover, the forward bias (Vf) of the LED changes with the used time of the LED and the temperature during using, for example, when the temperature rises, the forward bias (Vf) will decrease. If the LED is driven at a constant voltage, when the forward bias decreases, the voltage for emitting light will increase, and the produced luminance is higher than the expected value. On the contrary, if the forward bias increases, the voltage applied on the driving IC (integrated circuitry) increases, the voltage for emitting light will decrease, and thus the produced brightness is lower, which is a challenge for the case requiring stable luminance. Furthermore, the load of the driving IC will also change with the change of the above-mentioned forward bias.

SUMMARY OF THE INVENTION

In view of the above problem, the present invention is directed to a drive circuit for LED, which is used for providing a driving voltage to a plurality of LED strings connected in parallel, and real-time monitoring a string voltage of the LED strings, such that when the string voltage changes, appropriate compensation is made on the driving voltage, so as to maintain the luminance of the LED strings stable.

The drive circuit for LED is used for connecting a power and driving a plurality of LEDs to emit light. The LEDs are connected in series into a plurality of LED strings, and the LED strings are electrically connected in parallel. The drive circuit includes a power converter, which is connected with the power and converts into a driving voltage provided to the LED strings; a detection circuit, which is electrically coupled to the LED strings and has at least a reference voltage, and respectively detects a string voltage of the LED strings and compares the string voltage with the reference voltage, so as to output a control signal; and a report circuit, which is electrically coupled to the detection circuit and the power converter for receiving the control signal, and outputting to the power converter, and the power converter receives the control signal and adjusts the driving voltage according to the control signal.

When the string voltage is higher than the reference voltage, the power converter raises the driving voltage to drive the LED strings to emit light; and when the string voltage is lower than the reference voltage, the power converter reduces the driving voltage. Thereby, a constant voltage drop exists between the driving voltage and the forward bias of the LEDs, such that the drive circuit provides the same voltage to the LED strings for emitting light, and thus the produced luminance is more stable.

The above summary of the present invention and the following detailed description of the present invention are given for demonstrating and explaining the present invention, and for providing further explanation of the claims of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
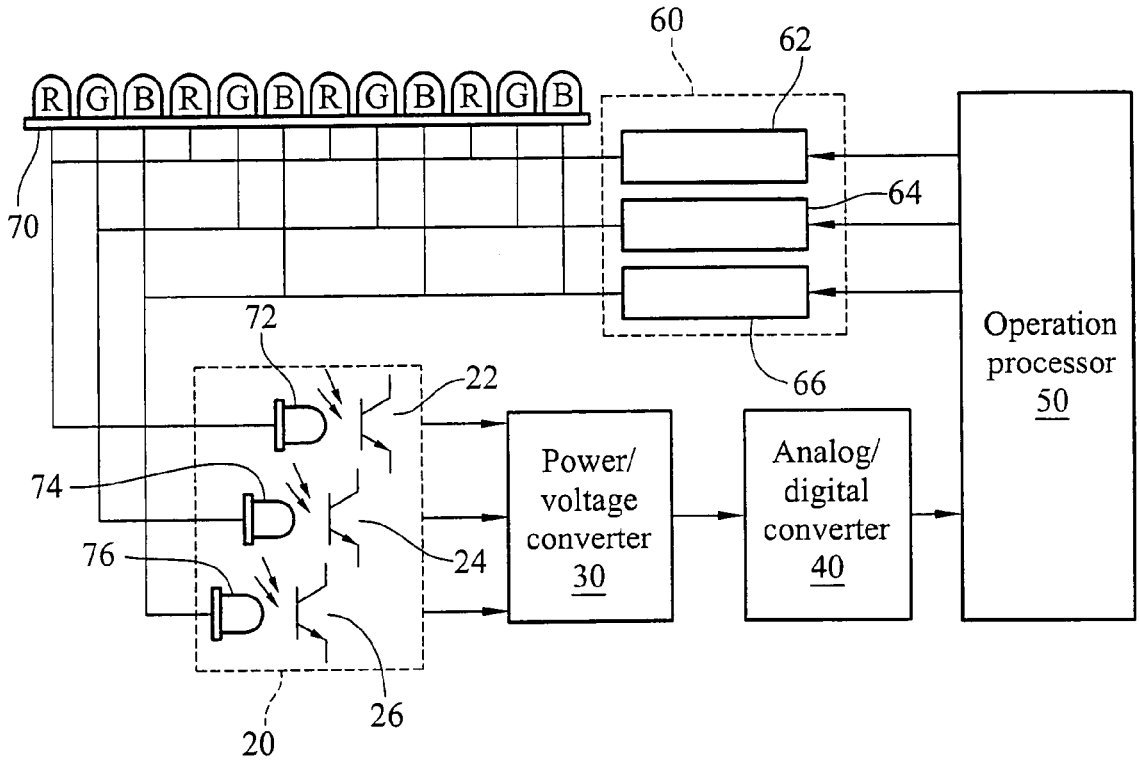
FIG.1(Conventional Art)
FIG. 1 is a schematic view of an optical energy detection and feedback system of the conventional art.
Figure 2:
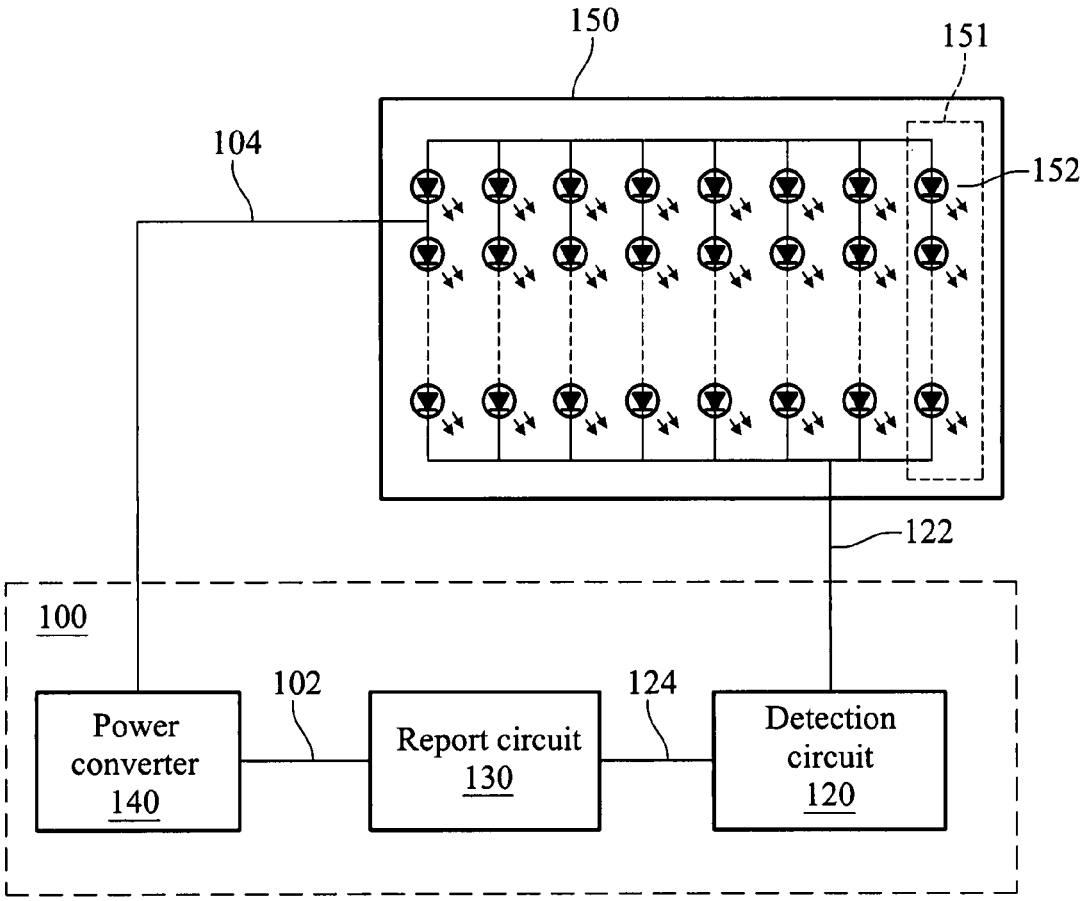
FIG. 2 is a circuit block diagram of a first embodiment of the present invention.

FIG. 2 is a circuit block diagram of a first embodiment of the present invention. It can be found from FIG. 2 that the drive circuit 100 for LED of the present invention is used to drive an LED group 150 that includes a plurality of LED strings 151 connected in parallel (in FIG. 2, an LED group 150 includes eight LED strings 151). Each LED string 151 is includes a plurality of LEDs 152 connected in series. The drive circuit 100 drives the LED group 150 through providing a constant voltage or a constant current, and in the present invention, the drive circuit 100 uses a constant voltage to drive the LED group 150. The drive circuit 100 can drive all of the LED strings 151 at the same time, or can selectively drive a specific LED string 151 to emit light and drive each LED string 151 sequentially and repeatedly, such that the LED strings 151 are all driven. Meanwhile, if the switching speed is high enough, e.g., the switching time is less than 1/30 second, to human eyes, each LED 152 is constantly on without being off.

Referring to FIG. 2, it can be found from FIG. 2 that the drive circuit includes a power converter 140, a report circuit 130, and a detection circuit 120. The power converter 140 is connected to an external power (not shown) and converts the power to provide a driving voltage 104 to the LED strings 151. The above conversion is determined according to the characteristic of the external power. Generally, if the external power is a DC power, the power converter 140 performs a voltage conversion and stably outputs a driving voltage 104, and if the external power is an AC power, the power converter 140 performs AC/DC conversion, rectification, voltage reduction and voltage stabilization, so as to output the driving voltage 104.

The detection circuit 120 is electrically coupled to the LED strings 151, so as to detect the string voltage 122 of the LED strings 151 respectively, and the detection circuit 120 has at least a reference voltage (as described in detail below). When the detection circuit 120 detects the string voltage 122, the string voltage 122 is compared with the reference voltage, so as to output a detection signal 124 to the report circuit 130 for the subsequent process of the report circuit 130.

The above reference voltage is an average value of the initial light emitting voltages when the LED strings are driven to emit light, or an average value of the light emitting voltages after the LED strings 151 emit light stably in a normal state. The main purpose is for presetting the reference voltage when the LED emits light in a normal state in the system (drive circuit), such that after the entire LED group 150 is used for a period of time or when the environmental temperature or the operating temperature changes, the changed voltage of the whole LED strings 151 is compared with the reference voltage, and is further adjusted, so as to maintain the luminance of the LED strings 151.

The reference voltage of the detection circuit 120 is produced directly by obtaining a power from a power end, and switching with an appropriate voltage dividing circuit or voltage reducing circuit. Then, the method for comparing the reference voltage with the string voltage 122 of the detection circuit 120 can be, but is not limited to be, realized with a comparator. When the reference voltage and string voltage 122 are used as two input ends of the comparator, an output end of the comparator will produce the above detection signal 124.

The report circuit 130 is electrically coupled to the detection circuit 120 and the power converter 140, for receiving the detection signal 124 and outputting the control signal 102 to the power converter 140, and the power converter 140 receives the control signal 102 and adjusts the driving voltage 104 according to the control signal 102. The control signal 102 transmitted back to the power convert 140 by the report circuit 130 can be an analog signal or a digital signal. For example, if the detection signal 124 detects a voltage difference of 2V between the reference voltage and the string voltage 122, when an analog signal manner is adopted, the control signal 102 transmitted by the report circuit 130 is directly transmitted to the power converter 140 as 2V. If the transmission is accomplished through a digital signal, depending on the resolution of the digital signal, the voltage of 2V is directly converted into a digital value and transmitted to the power converter 140, and the control signal 102 is resolved by the power converter 140 and the outputted driving voltage 104 is adjusted.

When receiving the control signal 102, the power converter 140 adjusts the driving voltage 104 according to the control signal 102. The principle of the adjustment is that: when the string voltage 122 is higher than the reference voltage, the power converter 140 raises the driving voltage 104, and the increased value of the driving voltage 104 is subtracting the reference voltage from the string voltage 122. When the string voltage 122 is lower than the reference voltage, the power converter 140 reduces the driving voltage 104, and the reduced value of the driving voltage 104 is subtracting the string voltage 122 from the reference voltage.

One example of the principle of adjusting the driving voltage 104 is illustrated as follows below. If an LED string 151 has ten LEDs 152, and the forward bias of each LED 152 is 0.9, each LED 152 is estimated to emit light at 1.1V, and each LED 152 is assumed to have the same characteristic, thus the reference voltage is set to 9V (10×0.9, i.e., the sum of the forward biases of the LED string 151), and the driving voltage 104 provided by the power converter 140 to the LED group 150 initially is 11V. After a period of operation, it is assumed that the forward bias on the LED 152 decreases to 0.8 due to the light emission and environmental factors, at this time, the driving voltage 104 of the power converter 140 is still 11V, but since the forward bias of each LED 152 decreases to 0.8, the total difference of the forward biases is 0.1×10=1.0V, and the total difference of the forward biases is usually applied on the component (typically the IC, integrated circuit) connected in series there-with. Therefore, not only this component has an excessive load, but also the overall light emitting efficiency is lower. In this case, the detection circuit 120 detects that the string voltage 122 (the string voltage 122 is the sum of the forward biases when the LED string 151 operates) is only 8V, which has the difference of 1V with the reference voltage (9 V. Thus, a detection signal 124 representing 1V is outputted to the report circuit 130, the report circuit 130 outputs the control signal 102 representing 1V to the power converter 140, and the power converter 140 adjusts the driving voltage 104 to reduce by 1V to 10V, so as to maintain the operation of the whole system in a default state.

The detection and setting of the string voltage 122 and the reference voltage is based on the sum of the forward biases of the LEDs 152 of the LED strings 151. However, when the present invention is implemented, the operating voltage of the above component serially connected with the LED string 151 can also be applied. For example, as for the above example, when the serially connected component operates normally, the operating voltage is 2 V (11V-9V), and when the forward bias is reduced from 0.9V to 0.8V, the operating voltage changes to 3V (11V-8V), and thus the voltage applied on the serially connected component increases by 1V, and the change of the voltage can also be taken as the string voltage 122. However, if the string voltage 122 adopts this detection basis the corresponding reference voltage must also be set to 3V, such that the two voltages are consistent and have a comparison effect.

The reference voltage is used in a manner that the entire system uses the same reference voltage. In order that the reference voltage can better represent the string voltage 122 under a normal operational state and the difference between the LED 152 and the LED 152 can be eliminated, the detection circuit 120 can further has a plurality of reference voltages, and each reference voltage is corresponding to a string voltage 12, such that the adjustment of the system is more accurate. Therefore, the reference voltage is the initial light emitting voltage, the operating voltage during the operation in a normal state, or the forward bias during the operation in a normal state of the corresponding LED string 151. It is important that the effect of the present invention can be achieved only when the reference voltage is corresponding to the string voltage 122.

Figure 3:
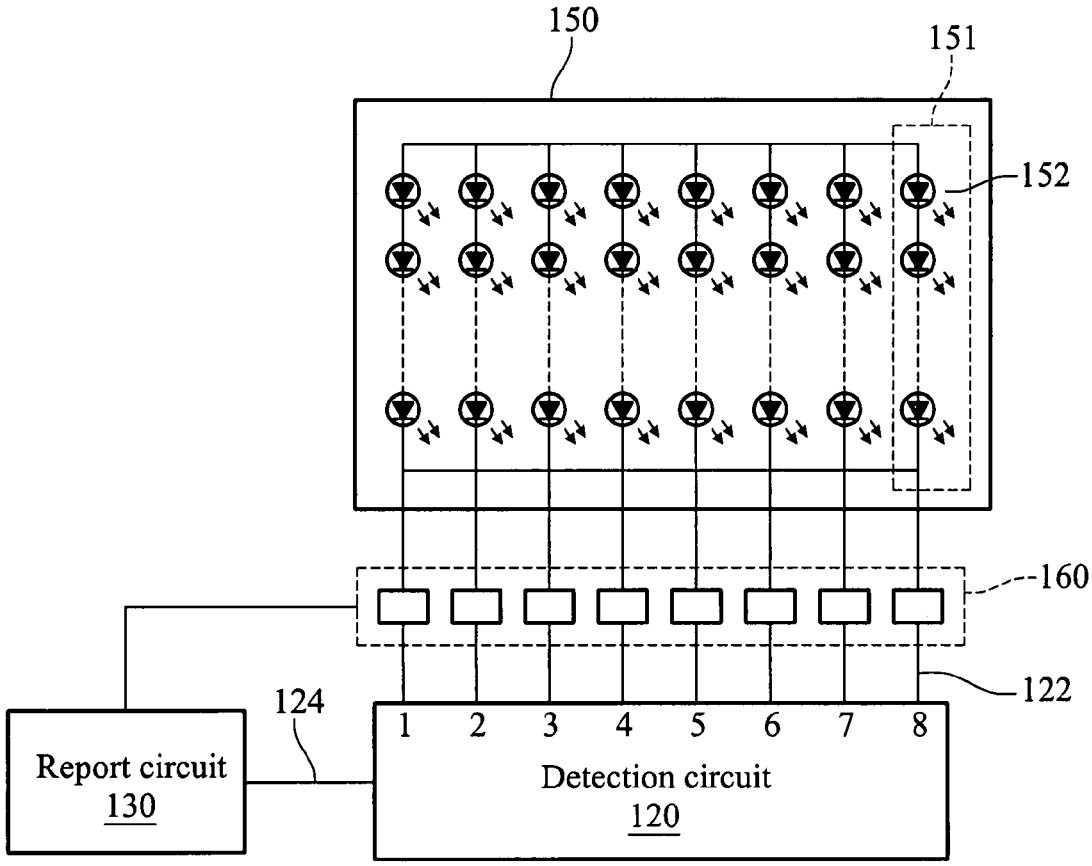
FIG. 3 is a circuit block diagram of a second embodiment of the present invention.

Furthermore, FIG. 3 is a diagram of a second embodiment of the present invention. It can be found from FIG. 3 that switch components 160 are corresponding to the LED strings 151, and the switch components 160 are electrically coupled to the LED group 150, the report circuit 130, and the detection circuit 120. The report circuit 130 selectively turns on one of the switch components 160, such that the power converter 140 drives the turned-on LED string 151 (the LED string 151 corresponding to the turned-on switch component 160). Thereby, only one LED string 151 is turned on at a same time point. In addition, the detection circuit 120 also only detects the string voltage 122 of the turned-on LED string 151, compares the string voltage 122 with the reference voltage, and outputs the detection signal 124 to the report circuit 130. The report circuit 130 then outputs the control signal 102 of the corresponding detection signal 124 to the power converter 140. The power converter 140 adjusts the driving voltage 104, so as to match the string voltage 122 (the sum of the forward biases during the operation) of the turned-on LED string 151. The switch components 160 can be, but are not limited to, transistors.

Therefore, in, the second embodiment, the report circuit 130 turns on a switch component 160 sequentially, or back and forth, or in any sequence, such that the turned-on LED string 151 is driven, and the driving voltage 104 of the turned-on LED string 151 is adjusted through continuous operation of the detection circuit 120, the report circuit 130, and the power converter 140.

More specifically, the report circuit 130 sequentially turns on one of the LED strings 151 at a time interval. During the time interval, the power converter 140 drives the turned-on LED string 151, and then the detection circuit 120 detects the string voltage 122 of the turned-on LED string 151 and compares the string voltage 122 with the reference voltage, so as to output the detection signal 124. The time interval can be, but is not limited to, 1/30 second, and an interval of 1/60 second or even shorter is also applicable, such that no interrupt is felt by human eyes when watching the LED group 150, and an LED group 150 emitting light continuously is felt.

Figure 4:
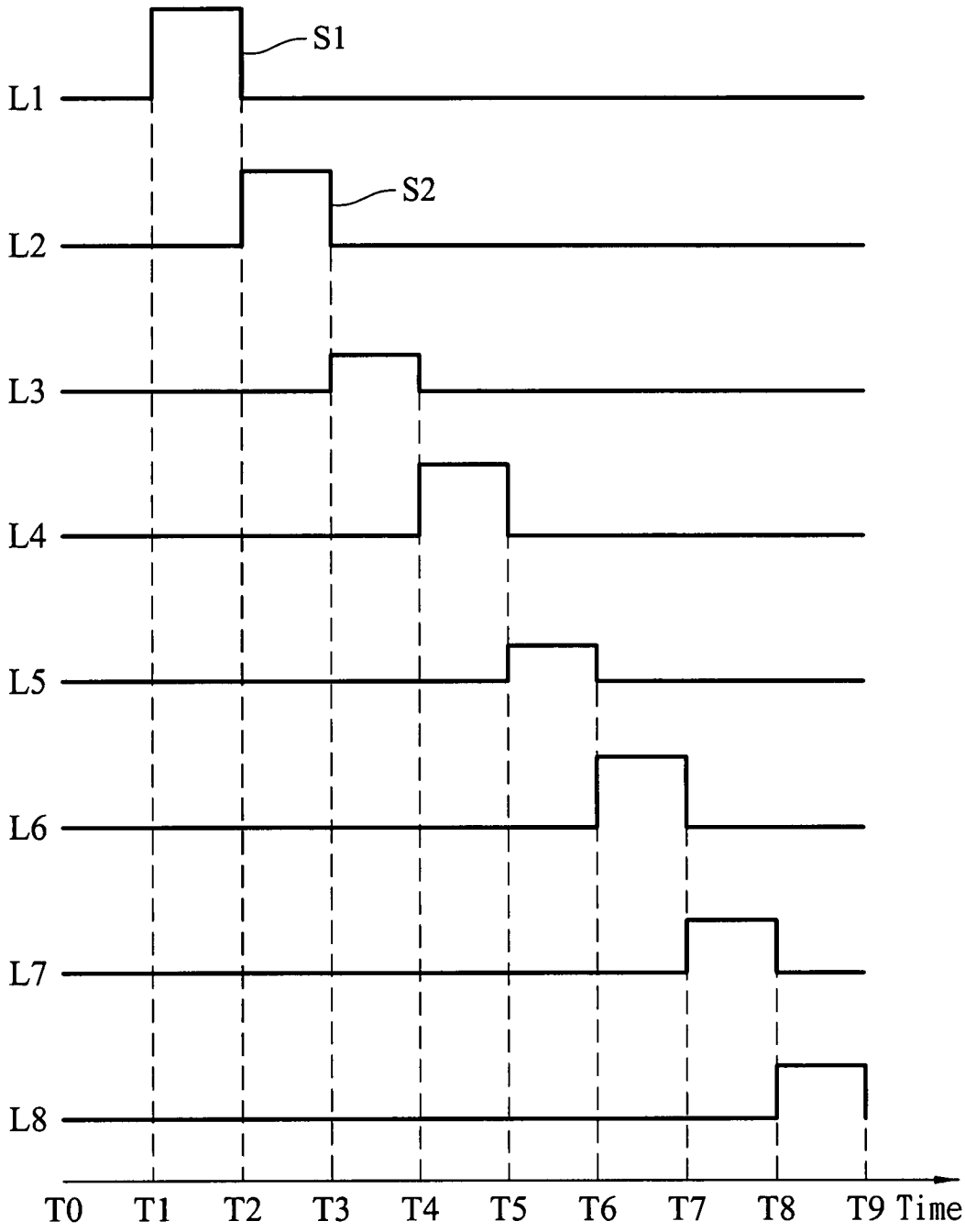
FIG. 4 is a timing chart of a control signal of a report circuit of the second embodiment of the present invention.

FIG. 4 is a timing chart of the control signal 102 of the report circuit 130 of the second embodiment of the present invention, in which the LED group 150 including eight LED strings 151 is taken as an example. Herein, the eight LED strings 151 are sequentially coded as L1, L2, L3, L4, L5, L6, L7, and L8. The report circuit 130 sequentially turns on the switch components 160 corresponding to the LED strings 151 according to the above sequence, and the detection circuit 120 also sequentially detects the string voltage of each LED string 151 and transmits the detection signal 124 to the report circuit 130. The report circuit 130 sends out the control signal 102, which is an analog signal in this example, according to the clock in a way in FIG. 4. It can be found from FIG. 4, at the T1 time point, the report circuit 130 outputs a control signal 102 of an analog voltage S1 corresponding to the LED string 151 of L1. In the interval of T2, the report circuit 130 outputs the control signal 102 of an analog voltage value S2 corresponding to the LED string 151 of L2, and so forth. The interval between T1 and T2 or T2 and T3 in the figure is the above interval. The shorter the interval is, the higher the light emitting stabilization of the LED group 150 will be.

It can also be found from FIG. 4 that the analog voltage value S1 is greater than the analog voltage value S2, which shows that the string voltage 122 of the LED string 151 of L1 is greater than the string voltage 122 of the LED string 151 of L2. At this time, the power converter 140 shall adjust the driving voltages 104 corresponding to L1 and L2 according to different control signals 102. The same principle is also applicable to other parts, and is not repeated again here.

Figure 5:
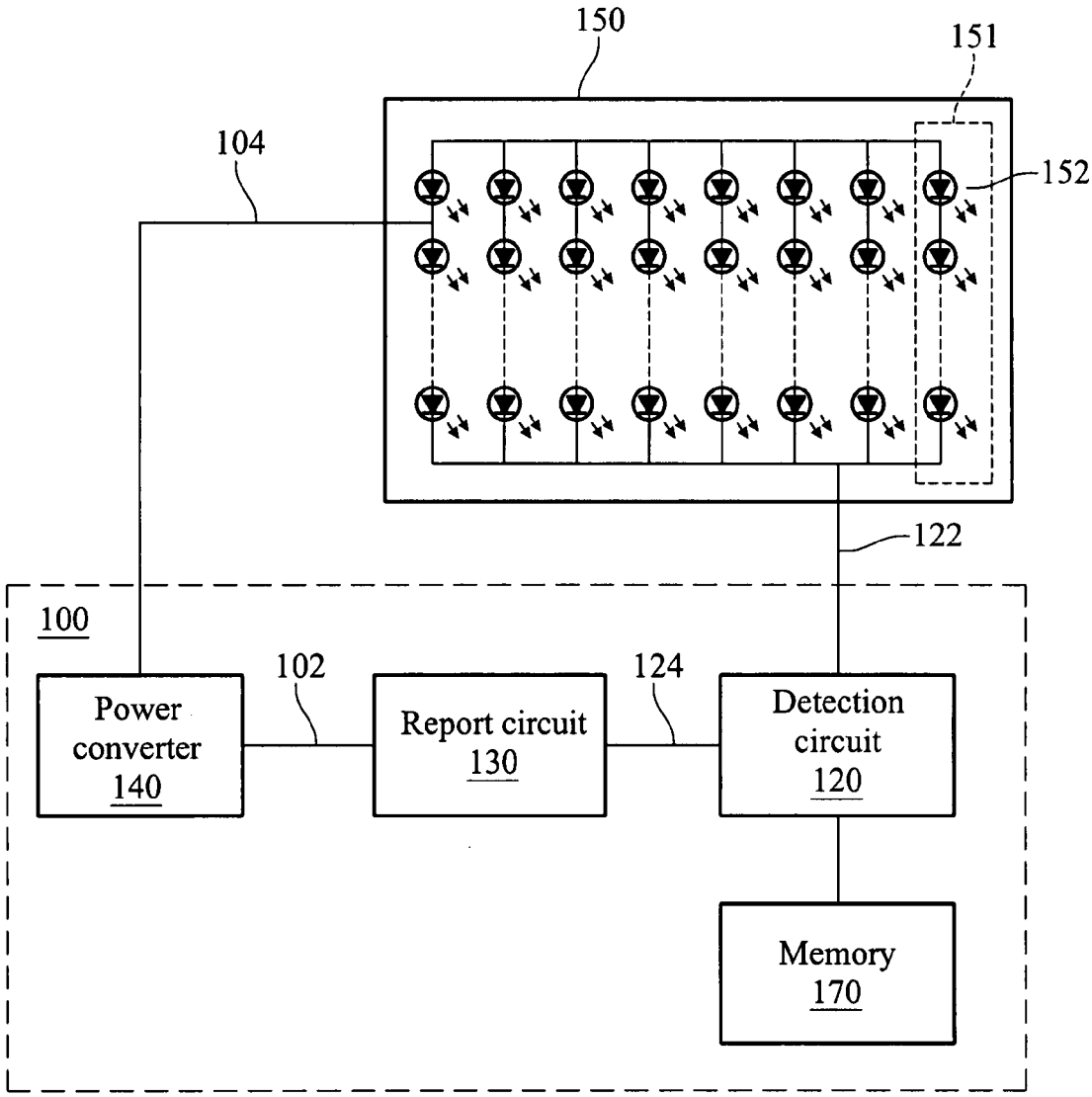
FIG. 5 is a circuit block diagram of a third embodiment of the present invention.

Furthermore, FIG. 5 is a diagram of a third embodiment of the present invention. It can be found from FIG. 5 that the detection circuit 120 is further electrically coupled to a memory 170, which stores the reference voltage of each LED string 151. Therefore, when the detection circuit 120 detects the string voltage 122 of a LED string 151, the reference voltage corresponding to the LED string 151 is obtained from the memory 170 for comparison, so as to output a detection signal. Thus, the above function can also be achieved. Moreover, the memory 170 can also be realized by using a variable resistor.

Finally, the reference voltage is compared when the detection circuit 120 detects the string voltage 122, so as to output a detection signal 124 to the report circuit 130. However, besides this method, the reference voltage also can be allocated at the report circuit 130. Thereby, the detection circuit 120 detects and outputs a string voltage 122 of the LED strings 151 respectively, and the report circuit 130 is electrically coupled to the detection circuit 120 and the power converter 140, and has at least a reference voltage. The report circuit 130 receives the string voltage 122 and compares with the reference voltage, so as to output a control signal 102 to the power converter 140, and the power converter 140 receives the control signal 102 and adjusts the driving voltage 104 according to the control signal 102.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drive circuit for light emitting diode (LED), connecting a power and driving a plurality of LEDs to emit light, wherein the LEDs are connected into a plurality of LED strings, the drive circuit comprising:

a power converter, connecting the power and converting into a driving voltage provided to the LED strings;

a detection circuit, electrically coupled to the LED strings and having at least a reference voltage, wherein the detection circuit detects a string voltage of the LED strings respectively and compares the string voltage with the reference voltage, so as to output a detection signal; and a report circuit, electrically coupled to the detection circuit and the power converter for receiving the detection signal and outputting a control signal to the power converter, wherein the power converter receives the control signal and adjusts the driving voltage according to the control signal, wherein the detection circuit has a plurality of the reference voltages, and the reference voltages are corresponding to the LED strings, so as to compare with the string voltage of the detected LED string respectively.

2. The drive circuit for LED as claimed in claim 1, wherein the report circuit selectively turns on one of the LED strings, such that the power converter drives the turned-on LED string, the detection circuit detects the string voltage of the turned-on LED string and compares with the reference voltage, so as to output the detection signal.

3. The drive circuit for LED as claimed in claim 2, wherein each of the LED strings has a switch component, the report circuit is respectively electrically coupled to the switch components, and the switch component is selectively turned on by the report circuit, so as to drive the turned-on LED string.

4. The drive circuit for LED as claimed in claim 2, wherein the report circuit sequentially turns on one of the LED strings at a time interval, during the time interval, the power converter drives the turned-on LED string, and the detection circuit detects the string voltage of the turned-on LED string and compares with the reference voltage, so as to output the detection signal.

5. The drive circuit for LED as claimed in claim 4, wherein the time interval is 1/30 second.

6. The drive circuit for LED as claimed in claim 1, wherein the reference voltage is an average value of a plurality of initial light emitting voltages of the LED strings.

7. The drive circuit for LED as claimed in claim 1, wherein each reference voltage is an initial light emitting voltage of the LED string corresponding to the reference voltage.

8. The drive circuit for LED as claimed in claim 1, wherein when the string voltage is higher than the reference voltage, the power converter raises the driving voltage.

9. The drive circuit for LED as claimed in claim 8, wherein an increased value of the driving voltage is subtracting the reference voltage from the string voltage.

10. The drive circuit for LED as claimed in claim 1, wherein when the string voltage is lower than the reference voltage, the power converter reduces the driving voltage.

11. The drive circuit for LED as claimed in claim 1, wherein the control signal is a digital signal.

12. The drive circuit for LED as claimed in claim 1, wherein the control signal is an analog signal.

13. A drive circuit for light emitting diode (LED), connecting a power and driving a plurality of LEDs to emit light, wherein the LEDs are connected into a plurality of LED strings, the drive circuit comprising:

a power converter, connecting the power and converting into a driving voltage provided to the LED strings;

a detection circuit, electrically coupled to the LED strings, and detecting and outputting a string voltage of the LED strings respectively; and a report circuit, electrically coupled to the detection circuit and the power converter and having at least a reference voltage, wherein the report circuit receives the string voltage and compares the string voltage with the reference voltage, so as to output a control signal to the power converter, the power converter receives the control signal and adjusts the driving voltage according to the control signal, wherein the report circuit has a plurality of the reference voltages, and the reference voltages are corresponding to the LED strings, so as to compare with the string voltage of the detected LED string respectively.

14. The drive circuit for LED as claimed in claim 13, wherein when the string voltage is higher than the reference voltage, the power converter raises the driving voltage.

15. The drive circuit for LED as claimed in claim 13, wherein when the string voltage is lower than the reference voltage, the power converter reduces the driving voltage.

* * * * *